US006457806B2

(12) United States Patent
Hickman

(10) Patent No.: US 6,457,806 B2
(45) **Date of Patent: *Oct. 1, 2002**

(54) INK-JET PRINT PASS MICROSTEPPING

(75) Inventor: Mark S. Hickman, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/909,370

(22) Filed: Jul. 19, 2001

Related U.S. Application Data

(63) Continuation of application No. 09/470,509, filed on Dec. 22, 1999, now Pat. No. 6,336,701.

(51) Int. Cl.[7] ..... B41J 23/00; B41J 2/15

(52) U.S. Cl. ..... 347/37; 347/40

(58) Field of Search ..... 347/19, 24, 37, 347/40, 41, 43, 104

(56) References Cited

U.S. PATENT DOCUMENTS

| | | | | |
|---|---|---|---|---|
| 4,621,273 A | | 11/1986 | Anderson | 347/40 |
| 4,922,268 A | | 5/1990 | Osborne | 347/19 |
| 4,922,270 A | | 5/1990 | Cobbs et al. | 347/19 |
| 4,963,882 A | | 10/1990 | Hickman | 347/41 |
| 4,965,593 A | | 10/1990 | Hickman | 347/12 |
| 4,967,203 A | | 10/1990 | Doan et al. | 347/41 |
| 4,999,646 A | | 3/1991 | Trask | 347/41 |
| 5,036,340 A | | 7/1991 | Osborne | 347/19 |
| 5,109,239 A | | 4/1992 | Cobbs et al. | 347/19 |
| 5,276,467 A | | 1/1994 | Meyer et al. | 347/19 |
| 5,341,225 A | | 8/1994 | Stein et al. | 359/498 |
| 5,349,375 A | | 9/1994 | Bolash et al. | 347/40 |
| 5,350,929 A | | 9/1994 | Meyer et al. | 250/573 |
| 5,430,306 A | | 7/1995 | Ix | 250/573 |
| 5,469,198 A | | 11/1995 | Kadonaga | 347/41 |
| 5,583,550 A | | 12/1996 | Hickman et al. | 347/41 |
| 5,600,350 A | | 2/1997 | Cobbs et al. | 347/19 |
| 5,663,624 A | | 9/1997 | Callaway | 318/696 |
| 5,825,378 A | | 10/1998 | Beauchamp | 347/19 |
| 5,883,644 A | | 3/1999 | Nicoloff, Jr. et al. | 347/12 |
| 6,264,298 B1 | * | 7/2001 | Mantell | 347/15 |
| 6,315,387 B1 | * | 11/2001 | Korikoshi | 347/40 |
| 6,336,701 B1 | * | 1/2002 | Hickman | 34/73 |

* cited by examiner

*Primary Examiner*—Hai Pham

(57) ABSTRACT

Micro-stepping a print media transport in an ink-jet hard copy apparatus such that the steps are smaller than the nozzle spacing of the drop generators on a printhead when using multiple printheads per colorant provides a resulting higher resolution pixel placement grid and allows choosing which nozzle to fire on which printing pass in order to optimize drop-to-drop alignment between the like colorant printheads.

13 Claims, 7 Drawing Sheets

INK-JET PRINT PASS MICROSTEPPING

CROSS REFERENCE TO RELATED APPLICATION(S)

This is a continuation of copending application Ser. No. 09/470,509 filed on Dec. 22, 1999, now U.S. Pat. No. 6,336,701, which is hereby incorporated by reference herein.

BACKGROUND OF THE INVENTION

1. Field of the Invention

The present invention relates generally to ink-jet printing and, more specifically, to microstepping the print media between printing passes in ink-jet hard copy apparatus having printheads firing the same colorant.

2. Description of Related Art

The art of ink-jet technology is relatively well developed. Commercial products such as computer printers, graphics plotters, and facsimile machines employ ink-jet technology for producing hard copy. The basics of this technology are disclosed, for example, in various articles in the Hewlett-Packard Journal, Vol. 36, No. 5 (May 1985), Vol 39, No. 4 (August 1988), Vol 39, No. 5 (October 1988), Vol. 43, No. 4 (August 1992), Vol. 43, No. 6 (December 1992) and Vol. 45, No. 1 (February 1994) editions, incorporated herein by reference. Ink-jet devices are also described by W. J. Lloyd and H. T. Taub in Output Hardcopy [sic] Devices, chapter 13 (Ed. R. C. Durbeck and S. Sherr, Academic Press, San Diego, 1988).

Generally, in the thermal ink-jet field, an ink-jet pen or print cartridge is provided with a printhead, having an orifice plate constructed in combination with heating elements. Thermal excitation of ink near nozzles at the orifice plate is used to eject ink droplets through the miniature nozzles and orifices onto a print medium, rendering alphanumeric characters or forming graphical images using dot matrix manipulation. Other types of ink droplet generators, such as the use of piezoelectric transducers, are also known in the art. This technology is also referred to a "pixel-array" printing; the term refers to a relatively large two-dimensional imposed array or matrix of uniformly spaced and sized cells called "picture elements," or "pixels" for short. By "turning on" certain pixels with ink, light, or the like, an image of text and graphics can be formed on the array. The intrinsic binary nature of this image becomes less obvious and the perceived image quality improves as the number of pixels per unit area increases (from unaided visual perception of individual dots at low resolutions to continuous image perception at high resolutions such as in photo-quality printing).

FIGS. 1 and 2 depict ink-jet hard copy apparatus, in this exemplary embodiment a computer peripheral printer, 101. A housing 103 encloses the electrical and mechanical operating mechanisms of the printer 101. Operations are administrated by an electronic controller 102 (usually a microprocessor-controlled printed circuit board) connected by appropriate cabling to a computer (not shown).

Cut-sheet print media 105, loaded by the end-user onto an input tray 107, is fed by a suitable paper-path transport mechanism—illustrated schematically in FIG. 2—to an internal printing station where graphical images or alphanumeric text is created. In an exemplary media transport as shown in FIG. 2, a sheet pick device 201 delivers a sheet 105 to a transport drum 203 and pinch roller 205 nip. The sheet 105 follows the drum 203 and paper guide 204 to the printing zone 207. Looking back to FIG. 1 also, a carriage 109, mounted on a slider 111, scans the print medium in the printing zone 207. An encoder 113 is provided for keeping track of the position of the carriage 109 at any given time. A set 115 of ink-jet pens $\mathbf{117}_{IN}$ (where I=ink color, N=redundant colorant pen number), having multiple printheads firing identical ink and one black ink pen 117K, is releasably mounted in the carriage 109 for easy access. In pen-type hard copy apparatus, separate, replaceable or refillable, ink reservoirs (not shown) are located within the housing 103 and appropriately coupled to the pen set 115 via ink conduits (not shown). Once a printed page is completed, the print medium is ejected by a selectively driven star wheel 209 (FIG. 2 only) into an output tray 119. The media advance axis is defined as the y-axis, the printhead scanning axis is the x-axis, and the printhead drop firing axis is the z-axis.

For convenience of description, the word "paper" will be used as synonymous for all types of print media; the word "ink" will be used for all compositions of colorants; the word "printer" will be used for all types of hard copy apparatus. No limitation on the scope of the invention is intended nor should any be implied.

The art and technology of ink drop placement are generally referred to as "print modes." Improving print quality by placing multiple drops on each pixel or overlapped in adjoining pixels are known ink-jet printing techniques; see e.g., U.S. Pat. No. 4,963,882 filed in December 1988 by Hickman for PRINTING OF PIXEL LOCATIONS BY AN INK JET PRINTER USING MULTIPLE NOZZLES FOR EACH PIXEL OR PIXEL ROW (Hickman '882), and U.S. Pat. No. 5,583,550 first filed in September 1989 by Hickman for INK DROP PLACEMENT FOR IMPROVED IMAGING. Hickman '882 describes the use of using multiple nozzles per pixel location or per pixel row; this also was also known as the dot-on-dot, DOD, print mode. U.S. Pat. No. 4,999,646 filed in November 1989 by Trask for a METHOD FOR ENHANCING THE UNIFORMITY AND CONSISTENCY OF DOT FORMATION PRODUCED BY COLOR INK JET PRINTING describes a print mode of overlapping complementary dot patterns, called "shingling." (Each is assigned to the common assignee herein and incorporated by reference.)

Multi-pass print modes are used to improve print quality by scanning each printed swath a number of times; see e.g., U.S. Pat. No. 4,967,203 filed in September 1989 by Doan et al. for an INTERLACE PRINTING PROCESS (assigned to the common assignee herein and incorporated by reference). In July 1989, Hickman filed for a now issued patent regarding PRINT QUALITY OF DOT PRINTERS, U.S. Pat. No. 4,965,593 (Hickman '593). No pixel locations adjacent to each other are printed on the same traverse by a printhead. In a single printhead having at least two colorant sources, the spacing between adjacent sources in the media advance direction is made an integer (greater than one) multiple of the fixed pixel spacing. The printhead traverses the paper in a direction perpendicular to the paper advance direction, simultaneously depositing droplets of the colorant such that colorant is not deposited onto transversely adjacent pixels by the colorant sources and achieving a higher print resolution than the nozzle spacing. Advancing a paper transport stepper motor in small increments is also discussed in Hickman '593.

In more recent ink-jet apparatus, separate printheads per color ink also have been used, mainly to improve throughput. In assignee's co-pending patent app. U.S. patent application Ser. No. 09/311,919, D. Pinkemell shows redundant pen sets mounted in the y-axis to allow simultaneous printing of multiple swaths. Multiple like-colorant printheads per swath have also been proposed, such as in the present applicant's U.S. patent application Ser. No. 09/233,575 for a DRUM-BASED PRINTER USING MULTIPLE PENS PER COLOR (also assigned to the common assignee here and incorporated by reference). In the basics, ink-jet pens are used in a printer so that the swaths printed by individual pens are combined into a resultant swath wider in the paper path advance axis than single pens of each ink could produce, increasing throughput. The print medium is carried on a drum and advanced through the printer. Sets of two pens, each set having the same color of ink, are carried near the drum with the two pens arranged such that the swath of one pen is adjacent to the swath of the other pen in a direction that is parallel to the drum axis. A carriage assembly provides an arrangement for combining the swath widths of the individual pens. The components of the carriage assembly are such that two pens of the same color ink are precisely positioned relative to each other, thereby to meet a very close tolerance requirement for arranging two pens of the same colorant.

Given the commercial desire for very high print resolutions, e.g., 1200+ dots-per-inch, and fast throughput, a fundamental issue of this technique is how to get adequate drop placement between drops from a first and a second (or "$n^{th}$") printhead of the set when the pens have intrinsic mechanical tolerance limitations of the carriage assemblies. Prior art solutions include mechanical alignment schemes—e.g., precision alignment boss designs, micro-machining of parts, post-assembly micro-alignment procedures. Such solutions are generally costly, complex, factory procedures and do not account for subsequent changes in mechanical alignment due to handling or due to operating conditions such as temperature change or materials creep.

Another methodology for printhead alignment improvement is to increase the spatial packing density of nozzles in each printhead array. If a perfect detection system were available, it would be possible to instruct the controller as to the real-time positional relationship of each nozzle; the closest nozzle to the correct printing target position can then be fired. Since semiconductor thin film fabrication techniques are already used to produce state of the art printheads, and nozzle sizes are already very small—e.g. $1/300^{th}$ inch diameter —improvements in increasing nozzle packing density are difficult, incremental in scope, and costly. A universal solution of merely increasing nozzle density does not appear to be feasible or at least commercially cost effective in the state of the art.

Another technique, shown in U.S. Pat. No. 4,621,273 by Anderson (assigned to the common assignee of the present invention and incorporated herein by reference) for a PRINT HEAD FOR PRINTING OR VECTOR PLOTTING WITH A MULTIPLICITY OF LINE WIDTHS, varies the arrangement of drop generators of the printhead. Such systems provide good results for specific image printing problems, but are not a universal fix.

Another technique, shown in U.S. Pat. No. 5,469,198 by Kadonaga (assigned to the common assignee of the present invention and incorporated herein by reference) for MULTIPLE PASS PRINTING FOR ACHIEVING INCREASED PRINT RESOLUTION has two, offset, black ink printheads on the carriage (as shown in FIG. 5 thereof) for a high quality mode, interstitial row printing in order to get 600 dot-per-inch ("DPI") resolution printing in the media advance axis from 300 DPI pens. In a first pass, both pens address odd-numbered 600 DPI raster rows and, in a second pass, addressing even-numbered rows (see FIG. 22). The pens are precisely mounted in accordance with details of the disclosure therein.

In hard copy apparatus providing multiple printheads of the same colorant, there is still a need for a method and apparatus for improving ink-jet drop placement accuracy while still using simple, cost-effective printhead designs.

SUMMARY OF THE INVENTION

In its basic aspects, the present invention provides a method for placing ink drops from a plurality of scanning ink-jet printheads onto a print medium in an ink-jet hard copy apparatus, wherein the print medium is transported along a media advance axis perpendicular to a printhead scanning axis, the printheads mounted for scanning the medium along a scanning axis and each printhead having a plurality of ink drop firing nozzles arranged as at least one column of nozzles parallel to the print medium advance axis having a predetermined nozzle packing density, a known relative alignment error between printheads, and a known nozzle spacing, and the print medium having a printing surface defined as a matrix of pixels arranged as adjacent horizontal rows and vertical columns at a resolution in the media advance axis greater than the nozzle packing density, the apparatus having a means for tracking real-time position of the printheads during scanning. The method includes the steps of:

a) providing the plurality of printheads wherein at least two printheads are provided for each colorant selectively simultaneous addressing both odd and even print rows and wherein the pen-to-pen spacing is not required as an integer multiple of nozzle spacing distance;

b) during a first scan of the printheads across the print medium wherein the nozzles have a real-time known positional relationship to the matrix, scan printing a first swath of columns of dots of each colorant in rows of the matrix by firing ink drop nozzles at target pixels using printhead nozzles of each of the at least two printheads of a same colorant wherein nozzles fired for each row are logically selected with respect to the known relative alignment error;

c) advancing the medium in the print medium advance axis a distance in accordance with the equation $$d=(m*S)+S/n,$$

where d=microstep advance distance, less than or equal to the nozzle overlap distance between printheads, m=a value of zero or any integer, S=nozzle spacing, n=an integer greater than one;

d) determining a new positional relationship of the nozzles to,he matrix;

e) during a second scan of the printheads across the print medium, scan printing the swath of columns of dots of each colorant in rows of the matrix by firing ink drop nozzles at target pixels using printhead nozzles of each of the at least two printheads of a same colorant wherein nozzles in the new positional relationship fired for each row are logically selected with respect to the known relative alignment error; and f) repeating the advancing the medium in the print medium advance axis a distance according to the equation in step c) between each scan printing of the swath until each horizontal row of target pixels has been addressed at least once.

In another basic aspect, the present invention provides an ink-jet printing method for printing a set of data with an inkjet hard copy apparatus having a plurality of ink-jet writing instruments wherein more than one instrument per colorant is mounted for scanning across a sheet of print media positioned by a transport means for selectively advancing the sheet along a print media advance axis in incremental steps through a printing zone of the apparatus, wherein each of the instruments has a plurality of nozzles arrayed in at least one column having nozzle spacing "S" and having a nozzle array axis parallel to the media advance axis wherein the nozzles can selectively fire ink drops onto the medium as a matrix of dotted pixels arranged as adjacent horizontal rows and vertical columns of pixels as the instruments are scanned across the sheet and wherein the instruments are mounted such that the more than one instrument per colorant will deposit ink drops in adjacent row sets of a predetermined swath of columns of pixels of the matrix, the nozzle array of each instrument of a colorant having a predetermined alignment offset to other instruments of the same colorant, the apparatus having a plurality of print mode settings for printing a range of dot resolutions on the sheet. The method includes the steps of: receiving a set of data representing a print job; selecting one of the print mode settings; setting a transport means paper advance distance as a function of the print mode setting such that the paper advance distance is a distance determined in accordance with the equation $$d=(m*S)+S/n,$$

where d=microstep advance distance, less than or equal to the nozzle overlap distance between printheads, m=a value of zero or any integer, S=nozzle spacing, n=an integer greater than one;

selecting a first data set representative of a first swath set of the set of data; performing a first scan of the writing instruments while printing data from the set representative of a first swath wherein nozzles firing drops of colorant onto all selected rows of the matrix are selected as a function of substantially instantaneous positional relationship of nozzles, including the predetermined alignment offset, to the data being printed during the scan, and wherein each colorant is selectively simultaneous addressing both odd and even print rows and wherein the pen-to-pen spacing is not required as an integer multiple of nozzle spacing distance; advancing the sheet the paper advance distance; performing another scan of the writing instruments while printing data from the set representative of the first swath wherein nozzles firing drops of colorant onto the matrix are selected as a function of substantially instantaneous positional relationship of nozzles, including the predetermined alignment offset, to the data being printed during the scan, and repeating the steps of performing another scan and advancing the sheet until the print data for from the set representative of the first swath is completely printed; selecting a next data set representative of a next swath set of the set of data and repeating the steps as for the first data set until all of the set of data has been printed.

In another basic aspect, the present invention provides an ink-jet hard copy apparatus for printing on sheet media, the apparatus having a transport means for moving a sheet from an input along a media advance axis through a printing zone of the apparatus. The apparatus includes: a set of ink-jet pens, including at least two pens for each color ink mounted for scanning in a scan axis perpendicular to the media advance axis and including at least one column of nozzles parallel to the media advance axis for depositing ink drops as dots on a rectilinear matrix of target pixels on the sheet that is greater than nozzle packing density of the pens and can be defined by a digital print job data set and wherein the column of nozzles of each respective pen depositing ink drops of a like color ink are aligned for printing individual rows of the matrix wherein a printed swath has a greater dimension in the media advance axis than possible by a single pen of one color ink and wherein any misalignment of nozzles are determinable in a known manner; means for selecting printing resolution for the print job data set; means for setting a media advance distance at d=(m*S)+S/n, where d=microstep advance distance, less than or equal to the nozzle overlap distance between printheads, m=a value of zero or any integer, S=individual nozzle spacing, n=an integer greater than one; and means for printing the print job data set as a series of contiguous swaths of data wherein each swath is printed in multiple scans such that each colorant selectively simultaneous is addressing both odd and even print rows and wherein the pen-to-pen spacing is not required as an integer multiple of nozzle spacing distance, and the sheet is advances by the media advance distance between each scan such that printing resolution is greater than nozzle packing density.

In yet another basic aspect, the present invention provides a computer memory for an ink-jet printer, including: computer readable code means for correlating predetermined print quality characteristics, ink-jet nozzle firing algorithm routines, and predetermined multi-printhead per colorant misalignments; computer readable code means for determining a print media microstepping distance along a print media transport axis perpendicular to an ink-jet nozzle scanning axis wherein the microstepping distance is a predetermined function of nozzle spacing, up to a distance less than or equal to ink-jet nozzle overlap distance between printheads of a same ink, and the predetermined print quality characteristics; and computer readable code means for multiple scan printing of a data set representative of a print job with the printer by printing each swath of the data set printing all raster rows in each pass and using the microstepping distance for moving the print media along the transport axis between each current swath scan.

In a further basic aspect, the present invention provides an ink-jet printing device including: means for correlating predetermined print quality characteristics, ink-jet nozzle firing algorithm routines, and predetermined multi-printhead per colorant misalignments; means for determining a print media microstepping distance along a print media transport axis perpendicular to an ink-jet nozzle scanning axis wherein the microstepping distance is a predetermined function of nozzle spacing, up to a distance less than or equal to printhead nozzle overlap distance between printheads of a same ink, and the predetermined print quality characteristics; and means for multiple scan printing of a data set representative of a print job with the printer by printing each swath of the data set by printing all raster rows in each pass and using the microstepping distance for moving the print media along the transport axis between each current swath scan.

One predetermined function is expressed as: d=(m*S)+S/n, where d=microstep advance distance, less than or equal to the nozzle overlap distance between printheads, m=a value of zero or any integer, S=individual nozzle spacing, and n=an integer greater than one.

Some advantages of the present invention are:

it allows the use of existing technology, lower nozzle packing density printheads in pens having multiple printheads per colorant to achieve improved print quality in multi-pass print modes;

it provides the ability for different printheads of the same colorant to address pixels of different raster rows in high resolution in a single pass;

it enables multi-pen, high resolution addressing in a system without complex mechanical devices to resolve pen alignment problems;

it provides for a lower cost of manufacture;

it provides higher addressable resolution in the paper transit axis than the inherent nozzle packing density; and it provides improved print quality.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

In analyzing the printing of pixels, one approach is to characterize the sheet of paper as having a rectilinear array of pixel locations—each being, e.g., $1/600^{th}$ inch square—which are candidate targets for ink drops. In color printing, some pixels receive no ink, some receive drops of one colorant to form a primary color, and some receive dots of two colorants, one superimposed over the other, to form a secondary color.

Figure 1:
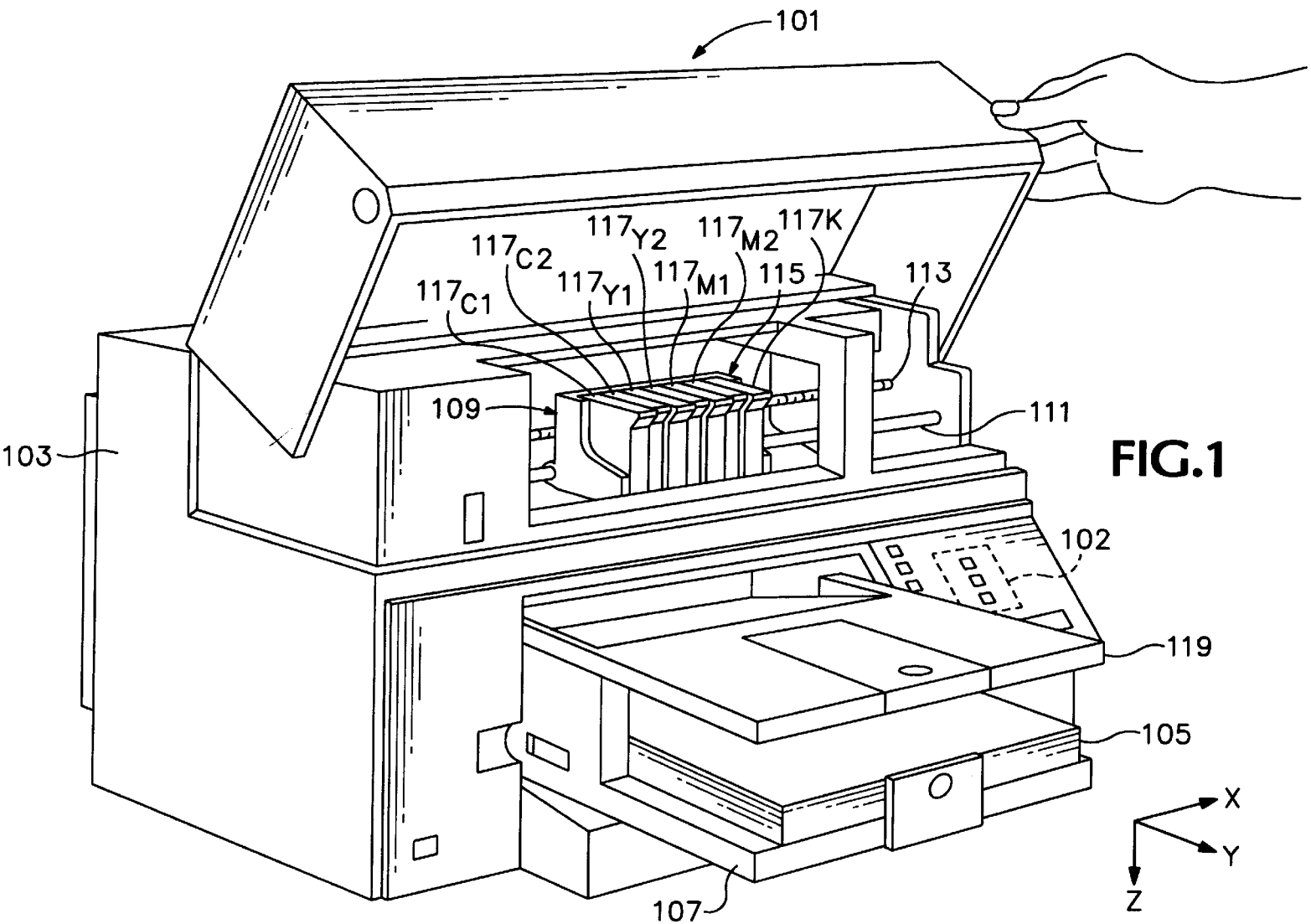
FIG. 1 is a schematic drawing in perspective view of a typical hard copy apparatus in which the present invention may be incorporated.
Figure 2:
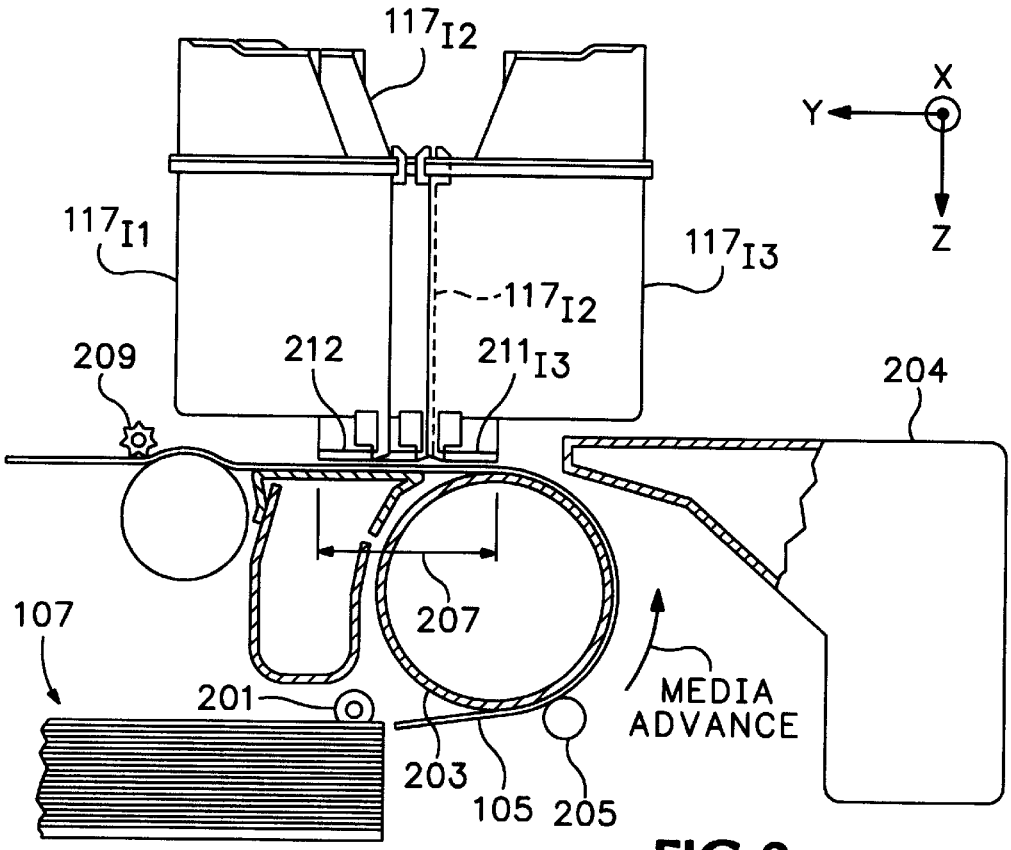
FIG. 2 is a schematic drawing in elevation view of a media pick-and-feed, transport apparatus and printing station in an ink-jet hard copy apparatus as shown in FIG. 1.
Figure 2A:
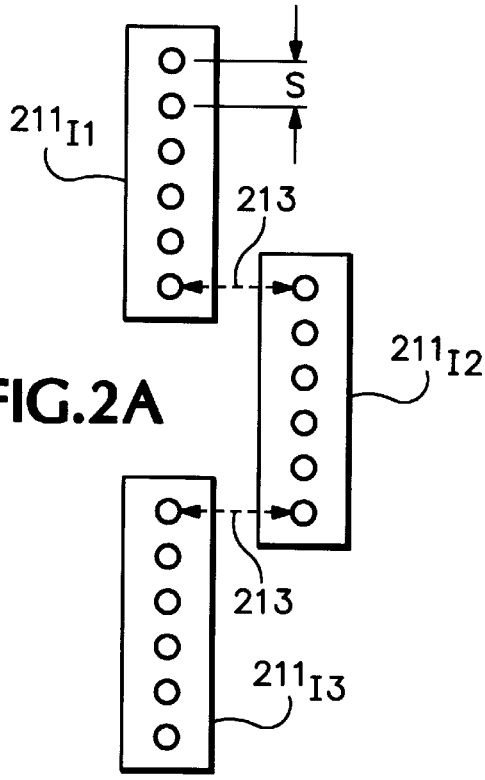
FIG. 2A is a detail of the printheads of FIG. 2.

In the present invention, referring to FIG. 2 where the perspective is along the pen-scanning x-axis, assume that three pens $\mathbf{117}_{IN}$ for each color "I" ink [cyan (C), magenta (M), and yellow (Y) and "N" being the pen 117 or its printhead 211 respective number for each colorant, e.g., 117C1/2111C1, 117C2/211C2 . . . 117M3/211M3, et seq.] are mounted in the carriage 109 (FIG. 1.) with the intent as shown in detail illustration of FIG. 2A (looking upwardly along the pen-firing z-axis from the media 105 toward the pens 117) that the printhead $\mathbf{211}_{IN}$ of each is perfectly aligned in the x-axis (represented by arrows 213), with the general intention being a one or more nozzle 212 overlap between printheads. It will be recognized by those skilled in the art that commercial printheads generally are fabricated using thin film or semiconductor processes to have at least two columns of nozzles with more than 100 nozzles per column and the columns offset by one-half nozzle spacing which allows high density, bidirectional printing, e.g., 1200 DPI. However, as explained in the Background section above, perfect alignment is generally not achieved. With state of the art nozzles having a nominal diameter and inter-nozzle spacing of $1/300^{th}$ (with $1/600^{th}$ inch offsets between columns), it can be recognized that the misalignments need only be an even smaller fraction to create dot misplacement on the paper.

The prior art also teaches a variety of techniques for determining actual printhead misalignments between pens mounted in a carriage. As further examples, U.S. Pat. No. 4,922,268 (Osborne) teaches a PIEZOELECTRIC DETECTOR FOR DROP POSITION DETERMINATION IN MULTI-PEN THERMAL INK JET PEN PRINTING SYSTEMS, and U.S. Pat. No. 5,600,350 (Cobbs et al.) teaches MULTIPLE INKJET PRINT CARTRIDGE ALIGNMENT BY SCANNING A REFERENCE PATTERN AND SAMPLING SAME WITH REFERENCE TO A POSITION ENCODER (each and other such patents are assigned to the present assignee and incorporated herein by reference.) One or more such techniques is used to determine actual printhead misalignments in a particular printer 101; further detail is not necessary to an understanding of the present invention. The actual misalignments for any given printer will then be a given data set to be used by the printhead firing algorithm in conjunction with each current print job data set defining pixel targets from which to proceed in accordance with the present invention to correct drop placement errors due to those actual misalignments.

In the same vein, techniques for print media advance is also highly developed. For example, U.S. Pat. No. 5,825,378 (Beauchamp) teaches CALIBRATION OF MEDIA ADVANCEMENT TO AVOID BANDING IN A SWATH PRINTER; U.S. Pat. No. 5,663,624 (Callaway) teaches a CLOSED-LOOP METHOD AND APPARATUS FOR CONTROLLING ACCELERATION AND VELOCITY OF A STEPPER; and U.S. Pat. No. 5,341,225 teaches an IMAGE SCANNING SYSTEM AND METHOD WITH IMPROVED REPOSITIONING (each assigned to the common assignee herein and incorporated by reference). One or more such techniques is used to calibrate and perform paper advance a distance less than the nozzle spacing, "S," referred to hereinafter as "microstepping," may be employed in accordance with the present invention; further detail of those methods and apparatus is not necessary to an understanding of the present.

Figure 3:
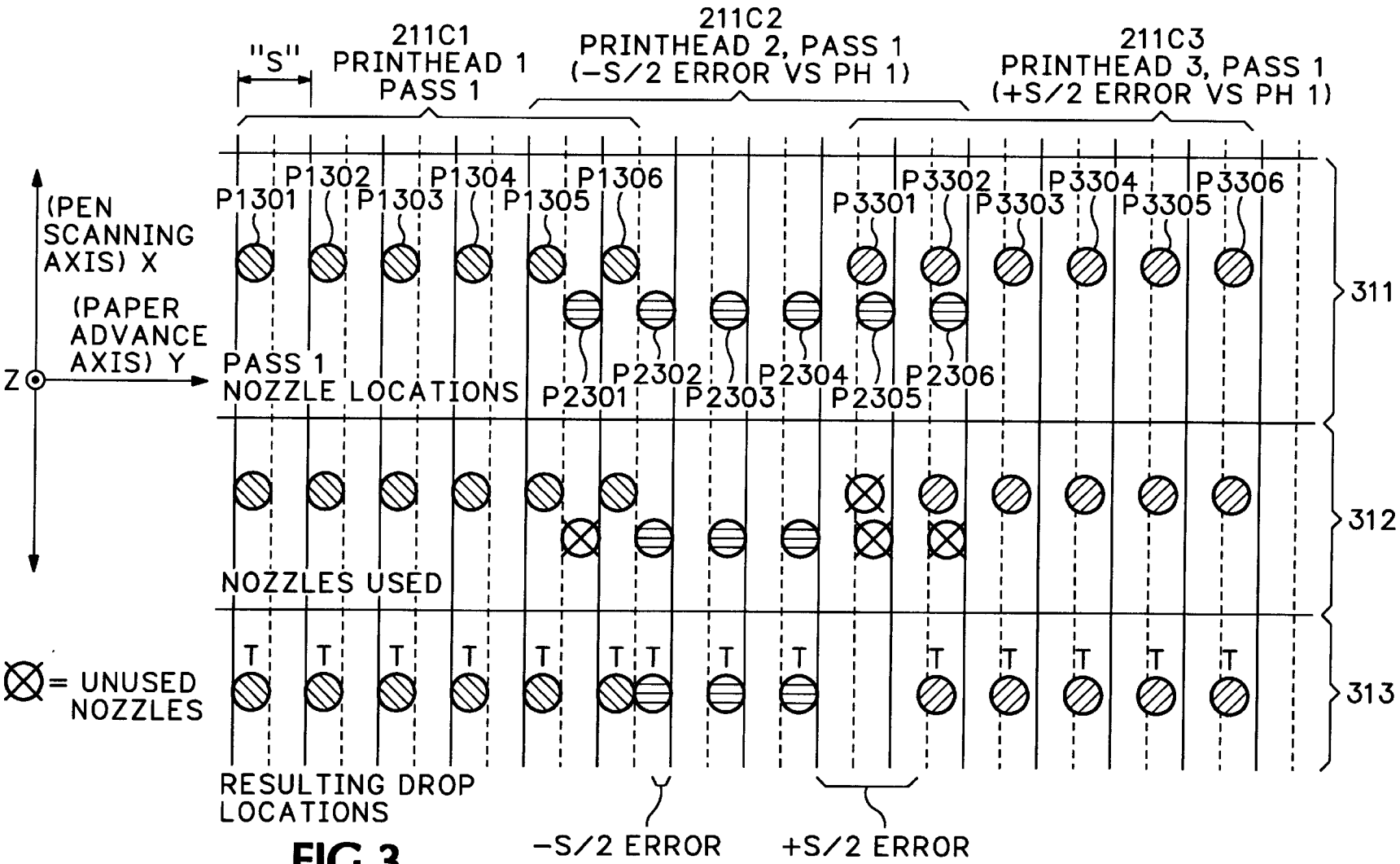
FIG. 3 is a schematic illustration of like colorant printhead misalignment operation.

FIG. 3 is a theoretical worst case printhead nozzle misalignment-drop placement layout that further illustrates the problem. [Note: for all the following FIGS. which show the methodology of the present invention, namely FIGS. 3–6, all dot placement errors are referenced to printhead number 1.] This example is an enlarged depiction of relative nozzle misalignments and resultant dot placement where multiple printhead, using the same colorant are use, with the printhead firing algorithm choosing the closest nozzle to the correct location of the print row of the pixel placement grid in a single pass. In this exemplary embodiment, assume that three printheads, having a predetermined overlap as shown or as provided in any specific implementation, are to fire like color ink drops; the drop-dot differentiation between the printheads is illustrated by using different shading for each of the printhead nozzles and their resultant printed dots. As shown, Printhead 1 having a linear array set of six nozzles P1301, P1302, P1303, P1304, P1305, P1306, is mounted relative to Printhead 2 having a linear array set of six nozzles P2301, P2302, P2303, P2304, P2305, P2306, which are offset in the x/scan axis and staggered in the y/paper advance axis with respect to Printhead 1 such that nozzle P1306 is interstitially located with respect to nozzles P2301 and P2302. Printhead 3, having a linear array set of six nozzles P3301, P3302, P3303, P3304, P3305, P3306, which are aligned in the y/paper advance axis with the nozzles of Printhead 1 (see also FIGS. 2 and 2A, printheads 211I1–3 with nozzles 212).

The worst case is that the nozzle misalignment between a single printhead actual and ideal location is S/2 (assuming ideal selection is made of which nozzles to fire). Thus, in FIG. 3 region 311 illustrates an inter-nozzle spacing "S" (targeted raster rows are represented by the spaces between the solid horizontal lines and dashed lines going across the FIG. in the pen-scanning x-axis) with normal paper advance to achieve a dot printing resolution of twice the inter-nozzle spacing is S/2, where e.g., $S=1/300^{th}$ inch (also represented by the dashed horizontal lines interspersed with the solid lines). Using as an example, cyan printhead 1, 211C1, as an offset reference (error correction techniques requiring an absolute reference), cyan printhead 2 is shown to have a −S/2 y-axis offset of its nozzle array 211C2 (where a minus sign designates upstream in the paper advance y-axis), and cyan printhead 3, 211C3, colorant is shown to have a physical offset of −(S+S/2), which by the firing algorithm nozzle selection is reduced to +S/2 y-axis offset (plus meaning downstream in the paper advance y-axis) and the relative offset between printhead 2 and printhead 3 approximately equal to S.

Using the best known mechanical tolerance alignment techniques), and assuming perfect detection and nozzle selection techniques, the worst case theoretical drop-dot error "$E_d$" for a given printhead relative to a target grid location is therefore defined as:

$$E_d=\pm S\div 2 \qquad \text{(Equation 1)},$$

assuming use of one of the above mentioned misalignment detection and use of firing the closest available nozzle to the target pixel firing algorithm techniques (in other words, firing only one drop at a raster row target pixel from the nozzle passing over the target (ignoring flight time and trajectory compensation) or, if no nozzle is passing over the target, the most closely aligned thereto).

In a first scanning pass, the nozzles are fired as illustrated by region 312 of FIG. 3, where unused nozzles—viz., not closest to target—are X'd out. Assuming that all pixels in the raster rows were intended to be inked in the current pass, the target pixels represented in region 313 by the letter "T." So, for example, nozzle P1306 is closest to, fires and hits the target pixel and nozzle P2301 is not used. Therefore, a firing algorithm choosing nozzle of each printhead closest to the correct target location to print the row (known from the current print job application output data set) will place ink drops and dot the paper as shown in region 313. Note that, the nozzles of printhead 2, 211C2, can only hit within an error of −S/2, while the nozzles of printhead 3, 211C3, only hit within an error of +S/2 and leaves a gap. Another complete pass of the same swath using adjacent pixel fill printing (see cited patents to Hickman, Doan, Trask, supra) would be subject to the same fill errors that would then be visible as printing errors, also known as "artifacts," to the naked eye.

Thus, stated generically, the microstepping is advancing the medium in the print medium advance axis a distance in accordance with the equation $$d=(m*S)+S/n, \qquad \text{(Equation 2)},$$

where d=microstep advance distance less than or equal to the nozzle overlap distance between printheads, m=a value of zero or any integer, S=nozzle spacing, n=an integer greater than one.

The upper limit of "d" ensures that all raster rows, odd and even numbered, can be addressed by each printhead; in other words, full addressability at twice the nozzle spacing is provided.

Figure 4:
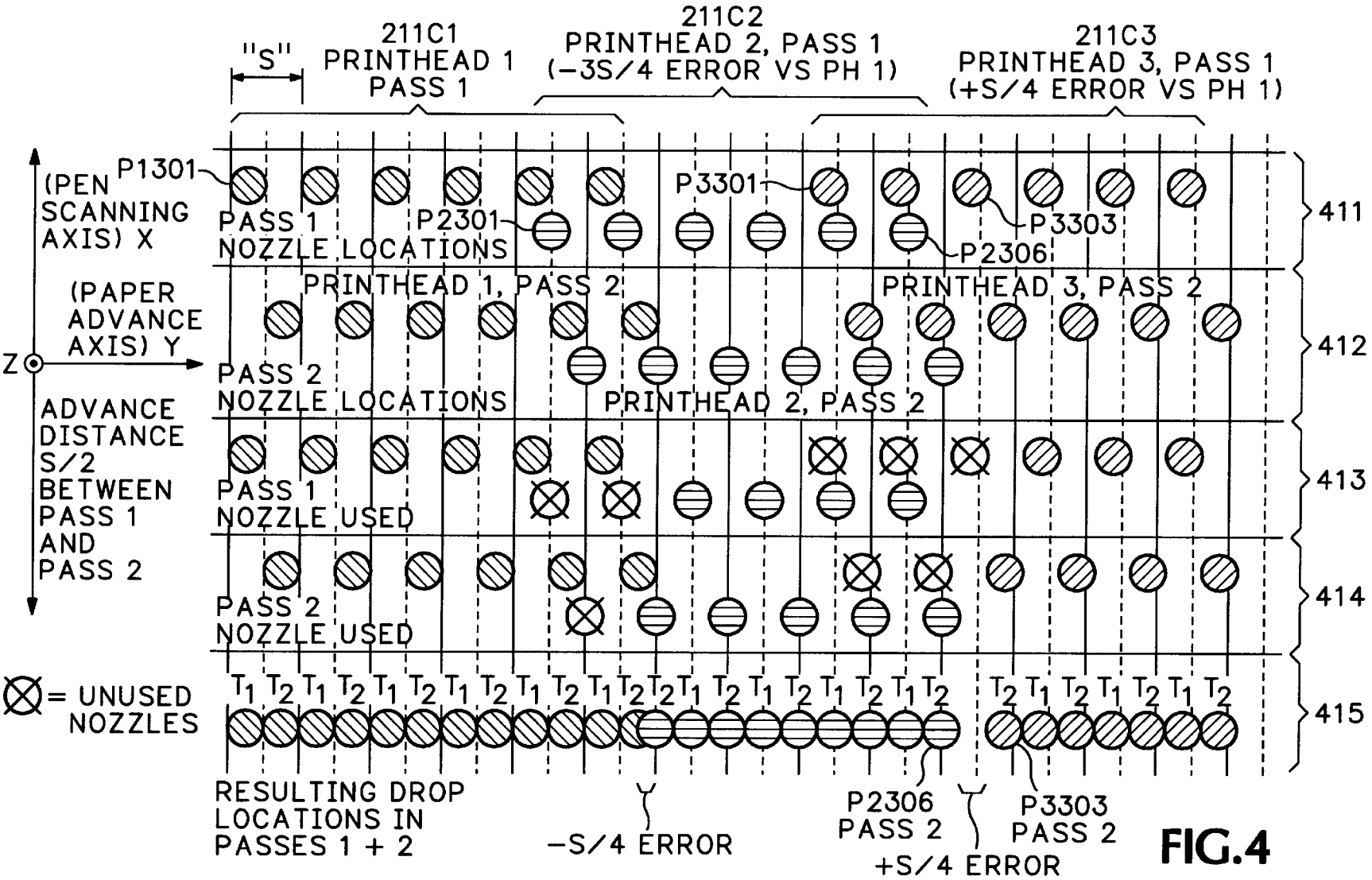
FIG. 4 is a first schematic illustration of the present invention showing a printhead misalignment, nozzle selection, and resultant ink drop locations.

FIG. 4 demonstrates a two-pass scenario in accordance with the present invention using microstepping of the media in the y-axis a distance of S/2 between passes over the swath. Referring to region 411 in this exemplary embodiment, the pre-measured misalignment from the ideal alignment of printhead 1, 211C1, and printhead 2, 211C2, is depicted as −¾S and the misalignment between printhead 3, 211C3, is shown as a physical offset of −(S+S/4) which by nozzle selection compensation is therefore +S/4 for print errors. This error was chosen as an example of the worst case error for this arrangement and usage of pens which is shown as an alternative arrangement to FIG. 3. For scan printing pass 1, region 411 again depicts the nozzle locations of each of the three printheads over the print media having relational target T1, where 1 is the pass number. Again using a firing algorithm selecting the nozzle closest to the target pixel, the nozzles actually fired in pass 1 are shown in region 413. The drops that will be deposited are shown in region 415 of the Figure, each labeled T1.

Before the next pass, pass 2, the media is advanced a distance S/2. The nozzle positions are now as shown in region 412. The nozzles fired in pass 2 are shown in region 414. The drops that will be deposited firing those closest respective nozzles are shown in region 415, each labeled T2. Note also that the microstepping can be an advance distance equal to an integer greater than one multiplied by S/2.

With microstepping, the error between printhead 1 and printhead 2 is approximately equal to −S/4 but results in overlapping or a reduction in drop gaps to a negligible amount, while the error between printhead 1 and printhead 3 is approximately +S/4. Thus, with microstepping the error between printheads 1 and 2 is approximately −S/2 and printhead 1 and printhead 3 is approximately +S/2. Therefore, knowing the misalignment, knowing the target pixels from the application, and knowing where all nozzles are relative to the target pixels before and after each microstep, a significant impact is made on improving the printed image quality in multipass print modes. The use of multiple printheads of the same colorant simultaneously providing higher throughput since the swath height printed in each set of passes is an equivalent multiple.

Figure 5:
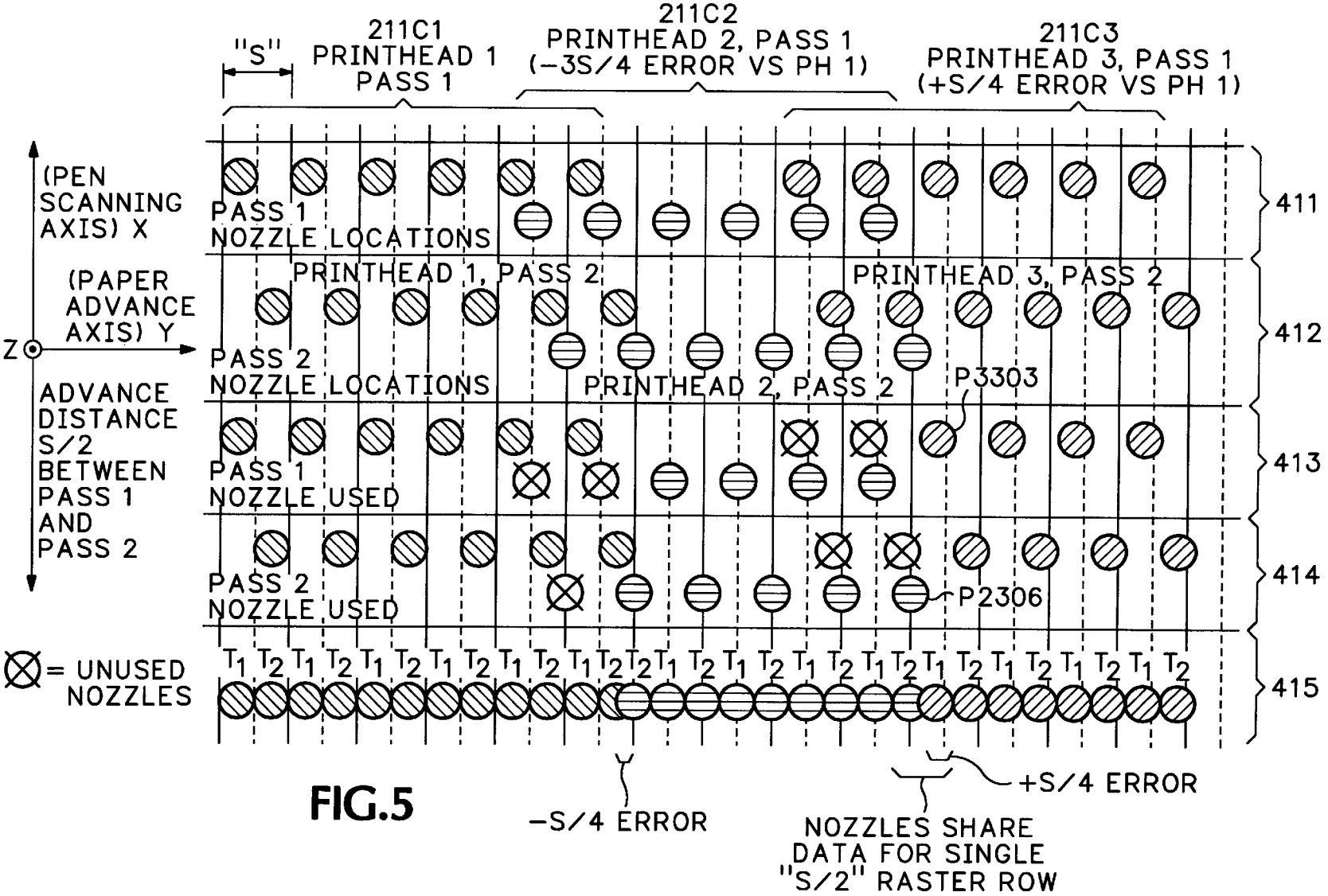
FIG. 5 is a second schematic illustration of the present invention showing a printhead misalignment, nozzle selection, and resultant ink drop locations.

FIG. 5 demonstrates another exemplary embodiment, using the same relative printhead misalignments as FIG. 4. The difference in this embodiment is that where the firing algorithm recognizes that a gap will be left in the pattern—such as in FIG. 4 where printhead 2 nozzle 306 and printhead 3 nozzle 303 are positioned in passes 1 and 2 respectively such that the shown gap in region 415 as neither was "closest" to an intended target during both passes. As can be seen, each nozzle is offset equidistant to the true target raster row. By the nozzle firing algorithm sharing the data for these gap "boundary" nozzles, the overlapped drops will fill the gap. In other words, in the firing of the nozzles when using multiple printheads of a common colorant, nozzle firing data can indicate a ½ density drop from two nozzles. In this case, both the shared data nozzles P2306, P3303 have the same pixel target in the raster row print data. Thus, in two passes all target pixels are essentially dotted even though the center of mass of the drops are offset by ±S/4.

Figure 6:
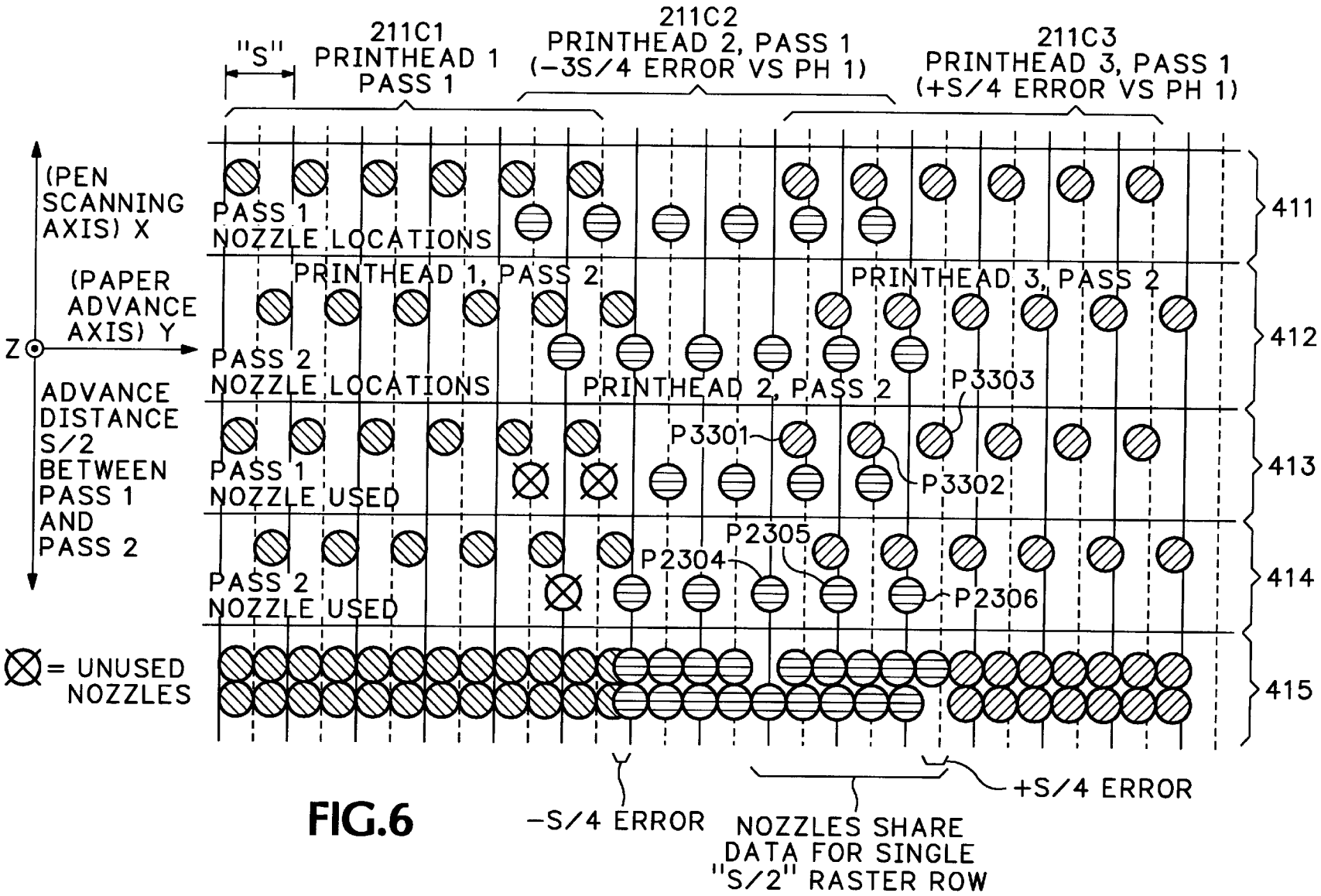
FIG. 6 is a third schematic illustration of the present invention showing a printhead misalignment, nozzle selection, and resultant ink drop locations.

FIG. 6 is another exemplary embodiment, using the same printhead construct as in FIGS. 4 and 5. However, in this firing sequence, all boundary nozzles, P2304, 305, 306 and P3301, 302, 303—that is overlapped nozzles between printheads—are fired in an order to fill regions where the closest nozzle is not clear. This is another technique for trying to get the tight amount of total ink per unit area on the paper. Drop placement is shown as two columns wide to show the ink drop volume averaging technique in this entire boundary region as another print quality manipulation to attain the right volume of ink per print area In the present invention, the use of microstepping in the paper advance axis is used during swath scanning, resulting in a higher resolution placement grid for choosing which nozzle to use on which printing pass in order to optimize drop-to-drop alignment between drops from differing printheads of the same colorant given the known printhead misalignment. Rather then providing the constant incremental advance of the print media equal to the nozzle spacing, e.g., for printheads having two columns of 1/300th inch nozzles staggered by 1/600th in to print at a resolution of 600 DPI, stepping one full nozzle height after the swath is printed and having dot placement errors of ±S/2, with a single microstep of ½ the nozzle spacing, or S/2, the error is reduced to ±S/4; likewise with three microsteps of ¼ the nozzle spacing, each move being S/4, the error is reduced to ±S/8, et seq.

The distance of a paper advance microstep need not be dependent on measured errors. For a given print mode, print quality, and type of media, the microstepping can be a constant. Generally, it will be advantageous to decrease the microstep distance as print quality print mode selection increases, e.g., to optimize throughput, a DRAFT mode selection by the end-user may force a non-microstepping printing operation to optimize throughput, a STANDARD mode selection, a microstepping of S/2, a HIGH QUALITY selection, a microstepping of S/4 with concomitant extra passes per swath. The selection criteria for the firing algorithm of which nozzles to choose for a given pixel target would be dependent on the measured errors from the referenced printhead.

Figure 7:
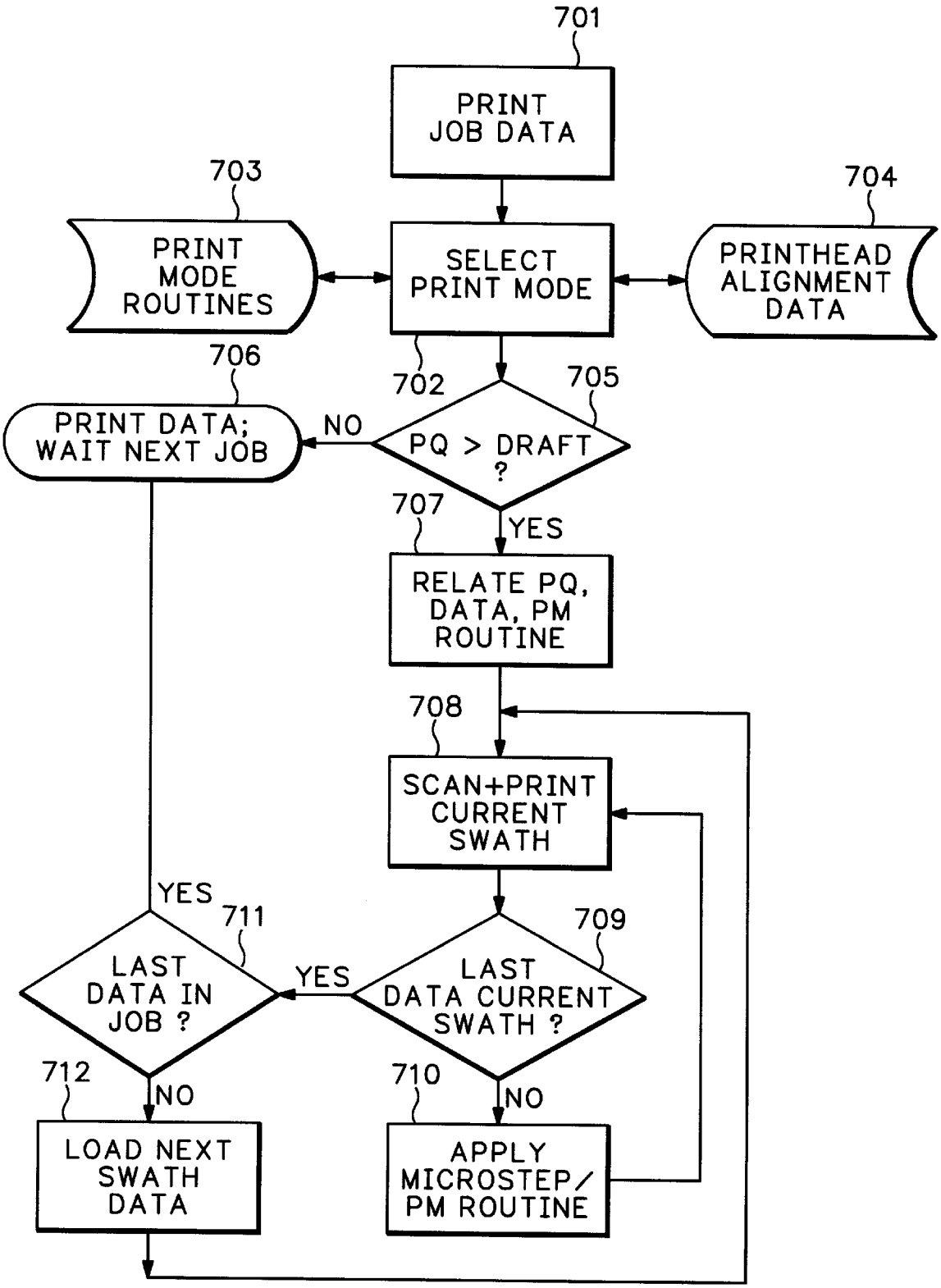
FIG. 7 is a flow chart of an ink-jet printing process in accordance with the present invention.

FIG. 7 is a flow chart depicting the general process in accordance with the present invention. It will be recognized by those skilled in the art that the methodology in accordance with the present invention may be implemented in a computer program code employing one or more subroutines and a variety of state of the art memory devices.

An user application generates a set of data for a print job, step 701, which is sent to an inkjet hard copy apparatus. Generally, such apparatus have a PRINT MODE selection, ranging from a high throughput (measured in pages-per-minute, "ppm") DRAFT MODE which uses the lowest print resolution (measured in dots-per-inch, DPI, on the sheet of paper which is representatively organized as a matrix array of rows and columns of picture elements ("pixels") to a HIGHEST QUALITY MODE (e.g., photo-printing). Commercial products such as the HP™ DeskJet™ ink-jet printers may have selection capabilities ranging from 150-DPI to 1200-DPI. Generally, the print mode is user selected, step 702, or automatically set to a most commonly used STANDARD MODE (e.g., 300-DPI). The apparatus will be preprogrammed with appropriate print mode routines 703 and factory printhead misalignment data 704. If the high throughput DRAFT MODE is selected, step 705, NO-path, since throughput is of the highest priority, the entire data set is merely printed swath-by-swath in the fewest number of swath scanning passes, namely one scan, and the hard copy apparatus enters a wait state for the next print job, step 706. However, if the PRINT MODE selected is for any print resolution greater than the high throughput DRAFT MODE, step 705, YES-path, multiple scans per swath and microstepping within each swath is to be employed. Therefore, the PRINT MODE routine selected, the print quality resolution as related to the type of media, the column and row pixel matrix locations in the print zone, and dot resolution, and the print job data set 701 are analyzed to correlate the known nozzle positional firing algorithm during each scan, including the known misalignment factors, with the current print job data set 701. As an exemplary firing algorithm, assume the closest nozzle to the target selection algorithm as discussed above is employed for the current print job for a STANDARD MODE print quality. The first swath data of the current print job data set 701 is loaded in a known manner data-buffering technique or the like for printing. A first scan is performed, firing the appropriate nozzles, step 708. As this is the first scan, step 709, NO-path, the media is microstepped a distance less than the nozzle spacing in accordance with the various routines available in relation to the print mode, e.g., S/2 as discussed above, step 710. The scanning and microstepping loop continues for the data until the current swath data processing is completed, step 709, YES-path. If data is also the last in the current job, step 711, YES-path, it is printed and the apparatus waits for the next job, step 703. If it was not the last swath of the job, the next swath data is loaded as the current swath, step 712, and the scanning and printing with microstepping process resumes, step 708.

Note also that the functions of the present invention can be programmed to be adaptive in a TEST mode. For example, the factory or, assuming the built in detection capability, the end-user may institute a test to determine the actual offsets between printheads. After determining the worst offset condition, a HIGHEST QUALITY mode microstepping distance can be selected to match that offset, and a longer step distance set for a STANDARD mode, e.g., twice the actual offset, thereby optimizing throughput for each available print mode.

It can now be recognized that the present invention uses state of the art nozzle arrays to provide high precision, high quality, high resolution printing. In multi-pass, multi-printhead per colorant apparatus, high throughput is achieved despite inherent physical limitations in mounting multi-pen per colorant by using discernable offsets to select firing algorithms while microstepping the media during swath printing by a distance less than the nozzle spacing of the printhead nozzle arrays.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. For example, while the exemplary firing algorithms like picking the closest nozzle to the target, or averaging the data to provide predetermined ink volume coverage were discussed, other firing algorithms—such as weighted error averaging with weighting based on recognized distances of drops from idea target locations, or the like as may be known in the art of ink-jet error correction—can be employed to the same end.

The embodiments were chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean one and only one unless explicitly so stated, but rather means one or more. Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "A means for . . ."

What is claimed is:

1. A computer memory for an ink-jet printer, comprising:

computer readable code means for correlating predetermined print quality characteristics, ink-jet nozzle firing algorithm routines, and predetermined multi-printhead per colorant misalignments;

computer readable code means for determining a print media microstepping distance along a print media transport axis perpendicular to an ink-jet nozzle scanning axis wherein the microstepping distance is a predetermined function of nozzle spacing, up to a distance less than or equal to ink-jet nozzle overlap distance between printheads of a same ink, and the predetermined print quality characteristics; and computer readable code means for multiple scan printing of a data set representative of a print job with the printer by printing each swath of the data set printing all raster rows in each pass and using the microstepping distance for moving the print media along the transport axis between each current swath scan, wherein the microstepping distance is defined in accordance with a predetermined function describing said microstepping distance.

2. The memory as set forth in claim 1, wherein the predetermined function is defined by the equation $$d=(m*S)+S/n,$$

where d=microstep advance distance, less than or equal to the nozzle overlap distance between printheads, m=a value of zero or any integer, S=individual nozzle spacing, n=an integer greater than one.

3. An ink-jet printing device comprising:

means for correlating predetermined print quality characteristics, ink-jet nozzle firing algorithm routines, and predetermined multi-printhead per colorant misalignments;

means for determining a print media microstepping distance along a print media transport axis perpendicular to an ink-jet nozzle scanning axis wherein the microstepping distance is a predetermined function of nozzle spacing described by an equation which limits the microstepping distance to a distance less than or equal to printhead nozzle overlap distance between printheads of a same ink, and the predetermined print quality characteristics; and means for multiple scan printing of a data set representative of a print job with the printer by printing each swath of the data set by printing all raster rows in each pass and using the microstepping distance for moving the print media along the transport axis between each current swath scan.

4. The device as set forth in claim 3, wherein the equation is $$d=(m*S)+S/n,$$

where d=microstep advance distance, less than or equal to the nozzle overlap distance between printheads, m=a value of zero or any integer, S=individual nozzle spacing, n=an integer greater than one.

5. A color ink-jet printer for printing a series of contiguous print swaths on a print medium, comprising:

a plurality of color inks;

printhead means for firing said color inks, wherein there are at least two printhead means for each of said color inks, said printhead means having nozzles simultaneously discharging ink drops in both odd and even print rows of a rectilinear matrix of target pixels, wherein the nozzles of said printhead means are logically selected for printing each row of pixels in a print swath with respect to a known relative alignment error; and means for microstepping advance of said medium in accordance with a function describing the distance of said microstepping as being less than or equal to a distance measuring nozzle overlap.

6. The printer as set forth in claim 5 wherein an equation for calculating microstepping distance is $$d=(m*S)+S/n,$$

where d=microstep advance distance, less than or equal to the nozzle overlap distance between printheads, m=a value of zero or any integer, S=nozzle spacing, n=an integer greater than one.

7. A method for ink-jet swath printing on a medium, the method comprising:

providing a plurality of inks, said plurality of inks having more than one color;

swath scanning a printhead means for firing said inks, wherein there are at least two printhead means for each said color, said printhead means having nozzles simultaneously discharging ink drops in both odd and even print rows of a rectilinear matrix of target pixels, wherein the nozzles of said printhead means are logically selected for printing each row of pixels in a print swath with respect to a known relative alignment error; and microstepping for advancing said medium in accordance with a function describing the distance of said microstepping as being less than or equal to a distance measuring nozzle overlap.

8. The method as set forth in claim 7 further comprising: printing a series of contiguous print swaths on the medium.

9. The method as set forth in claim 7 wherein said function is defined by an equation comprising:

$$d=(m*S)+S/n,$$

where d=microstep advance distance, less than or equal to the nozzle overlap distance between printheads, m=a value of zero or any integer, S=nozzle spacing, n=an integer greater than one.

10. The method as set forth in claim 9, the microstepping further comprising:

setting the advance distance as a function of S÷n, where S is the known nozzle spacing and n is an integer greater than one.

11. The method as set forth in claim 9 wherein the integer "n" is a function of selected printing resolution for print job data such that "n" increases as selected printing resolution increases.

12. The method as set forth in claim 7, the microstepping further comprising:

setting a transport means paper advance distance as a function of a print mode setting which increases print quality resolution.

13. The method as set forth in claim 12, the setting a transport means paper advance distance comprising:

decreasing the paper advance distance between scans of a swath as print mode setting increases print quality resolution.

* * * * *